United States Patent [19]

Debs

[11] 4,262,728

[45] Apr. 21, 1981

[54] VERTICAL BLIND

[75] Inventor: Victor Debs, Staten Island, N.Y.

[73] Assignee: Levolor Lorentzen, Inc., Hoboken, N.J.

[21] Appl. No.: 2,457

[22] Filed: Jan. 10, 1979

Related U.S. Application Data

[63] Continuation-in-part of Ser. No. 921,048, Jun. 30, 1978.

[51] Int. Cl.[3] ..... E06B 9/30

[52] U.S. Cl. ..... 160/168 R; 160/172; 160/176 R

[58] Field of Search ..... 160/166–178

[56] References Cited

U.S. PATENT DOCUMENTS

| | | | |
|---|---|---|---|
| 1,550,237 | 8/1925 | Beckman | 160/320 |
| 2,659,430 | 11/1953 | Lorentzen | 160/173 |
| 2,849,063 | 8/1958 | Achler et al. | 160/177 |
| 3,280,891 | 10/1966 | Eldredge et al. | 160/178 R |
| 3,463,219 | 8/1969 | Osterholz | 160/172 |
| 3,630,264 | 12/1971 | Debs | 160/177 |
| 3,878,877 | 4/1975 | Bruneau et al. | 160/168 |
| 3,921,695 | 11/1975 | Debs | 160/177 |
| 4,122,884 | 10/1978 | Salzmann | 160/178 R |
| 4,128,914 | 12/1978 | de Wit | 160/178 R |
| 4,140,169 | 2/1979 | Arena | 160/178 R |

*Primary Examiner*—Peter M. Caun

[57] ABSTRACT

In a vertical blind with a blind head and a number of carriers supported for reciprocating movement in the head, and holders respectively supported in the carriers for pivotal movement and adapted to support a plurality of vertical vanes therefrom, with a control for controlling the reciprocating movement of the carriers and pivotal movement of the holders including a tilt rod: first bevel gears respectively rotatably supported in the carriers and mounted for rotation with the tilt rod, and a second bevel gears respectively connected to the holders and respectively mounted for meshing engagement with the first bevel gears. The carriers are interconnected by special spacer bands and have special openings for receiving the cord for traversing or drawing the blind. The blind is also equipped with a simple arrangement for preventing the cord from sagging, without using an intermediate support.

32 Claims, 50 Drawing Figures

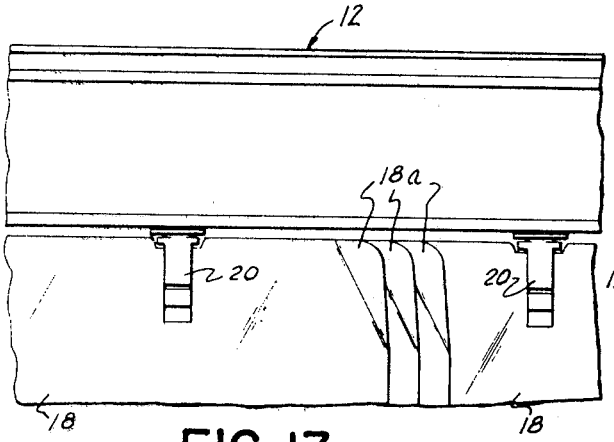
FIG. 13
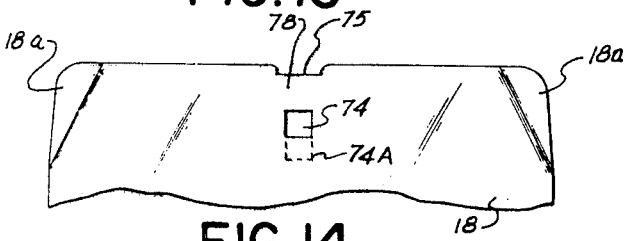
FIG. 14
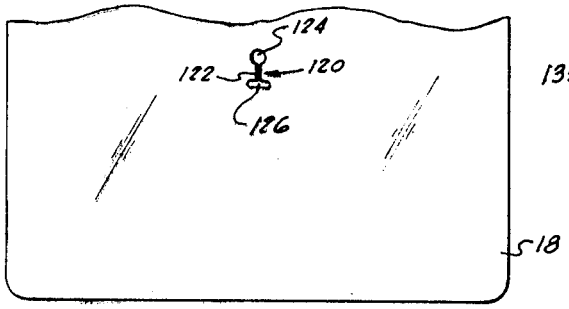
FIG. 15
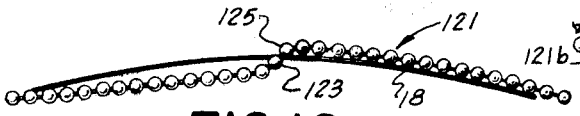
FIG. 16
FIG. 17
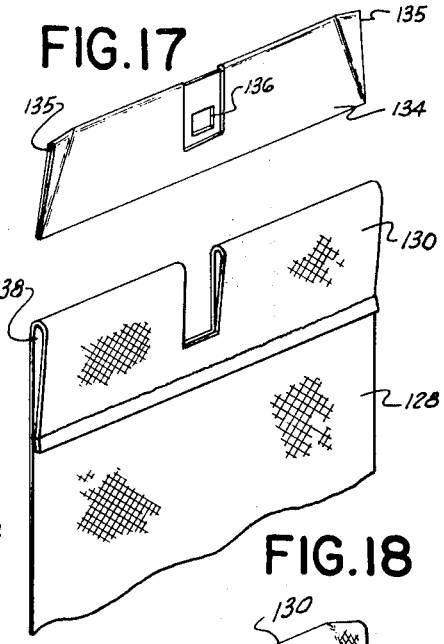
FIG. 18
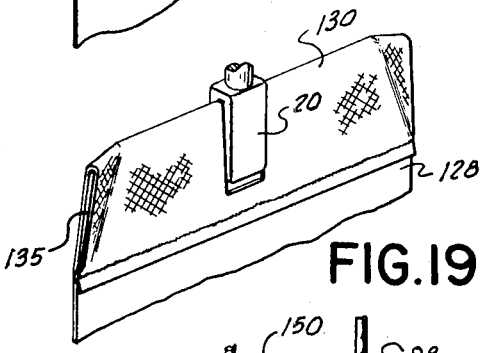
FIG. 19
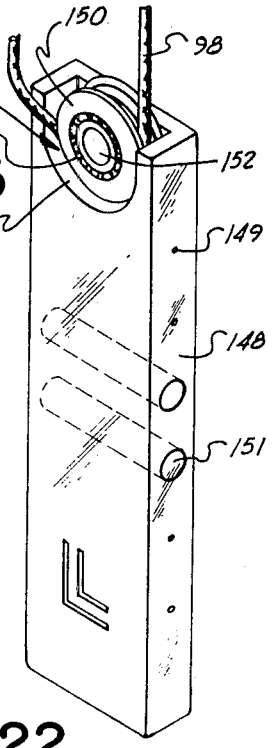
FIG. 23
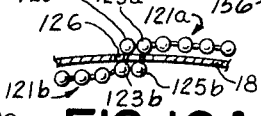
FIG. 16A
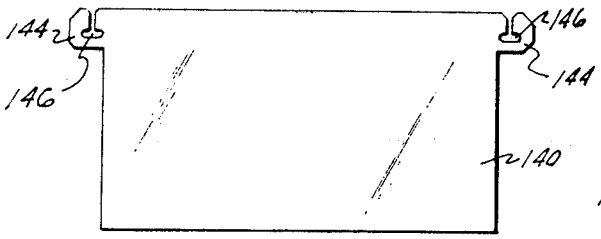
FIG. 20
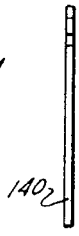
FIG. 21
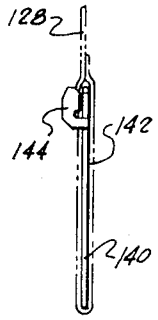
FIG. 22

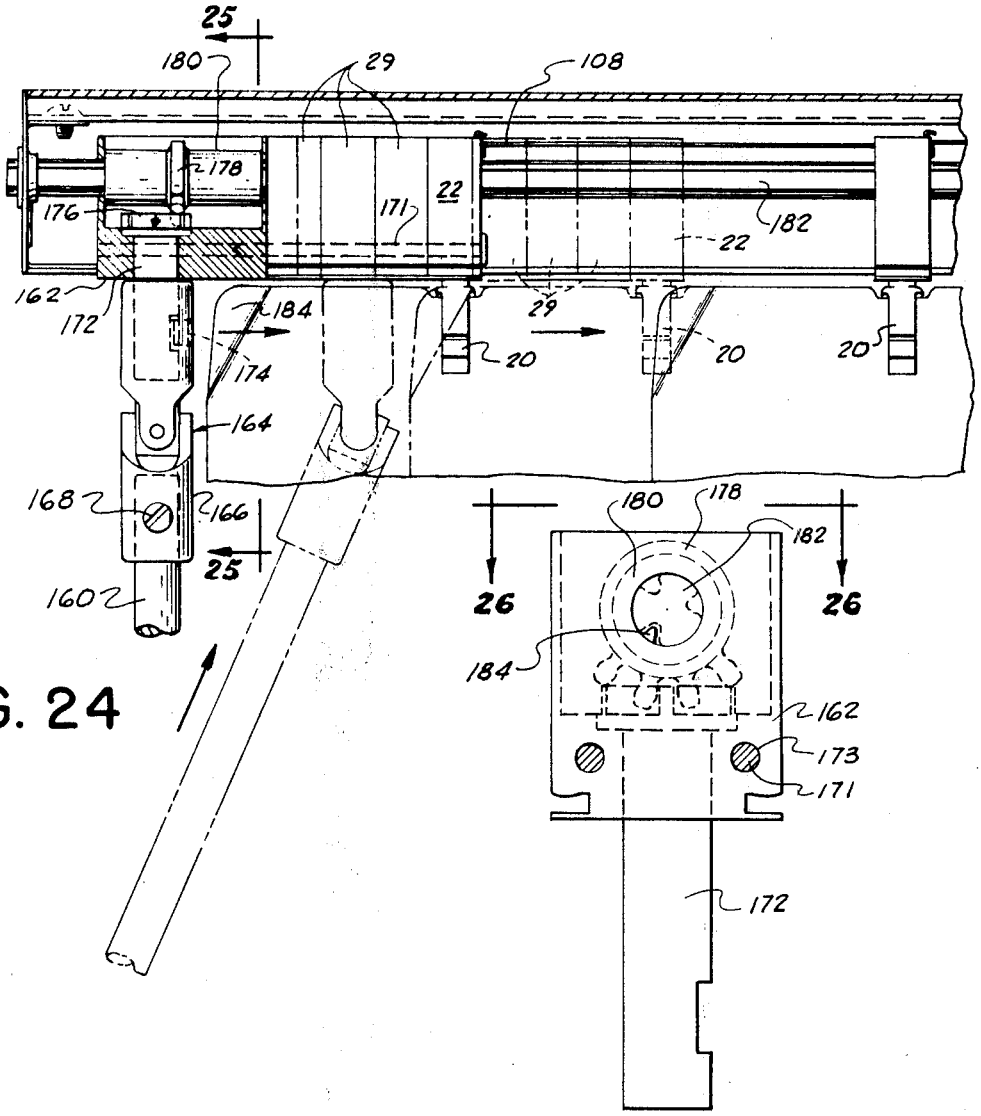
FIG. 24
FIG. 25
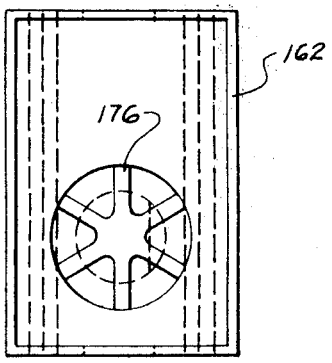
FIG. 26
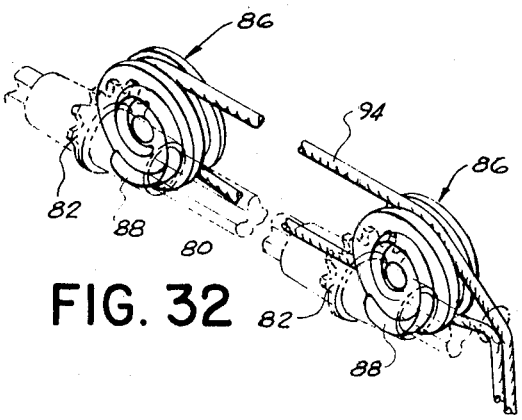
FIG. 32

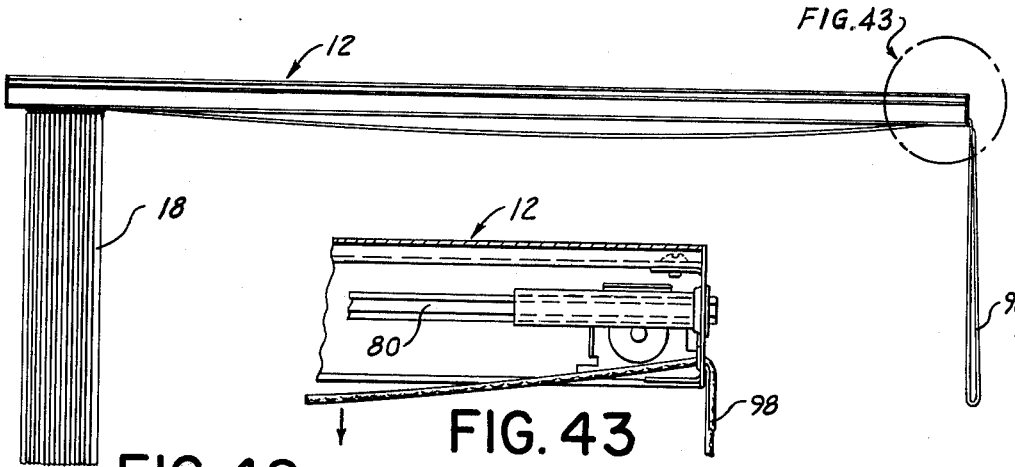
FIG. 42
FIG. 43
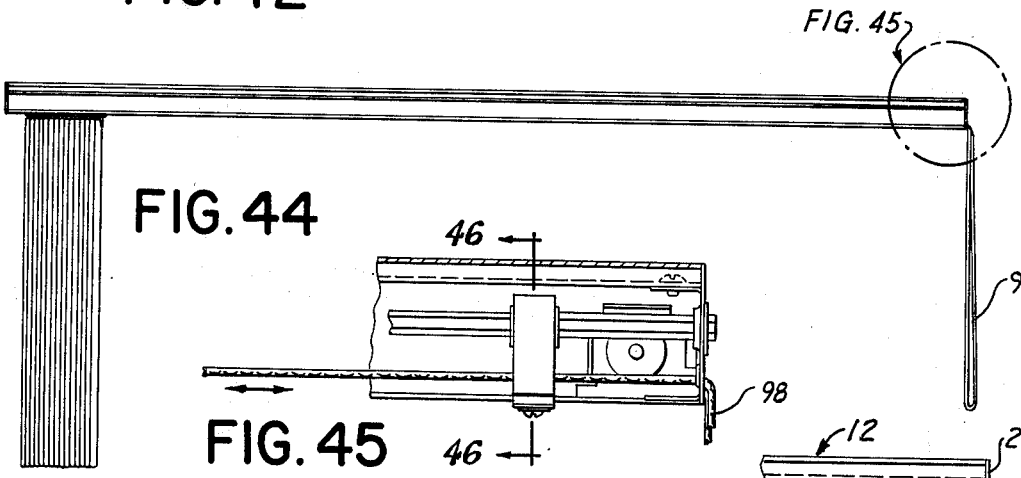
FIG. 44
FIG. 45
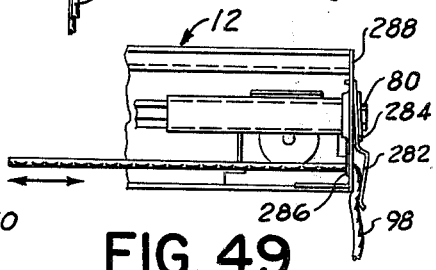
FIG. 49
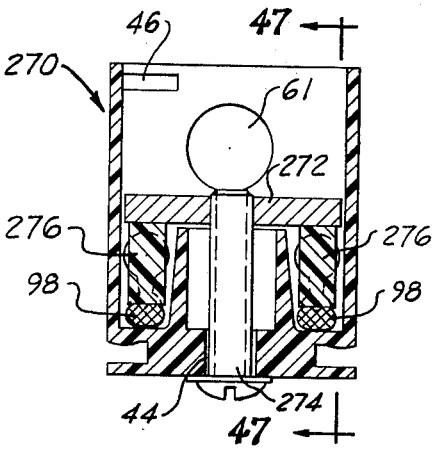
FIG. 46
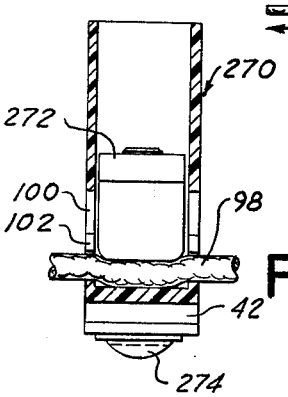
FIG. 47
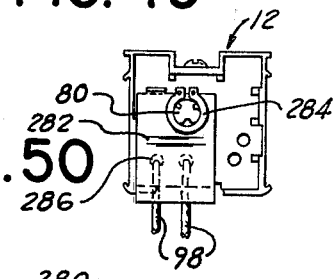
FIG. 50
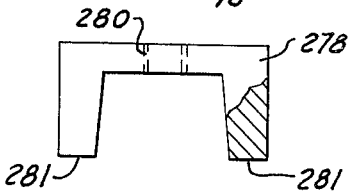
FIG. 48

VERTICAL BLIND

BACKGROUND OF THE INVENTION

This application in a continuation-in-part application of my co-pending application Ser. No. 921,048, filed June 30, 1978.

The present invention relates to a vertical blind, and more specifically to a vertical blind of this type which has several novel and improved features with respect to heretofore known vertical blinds.

It is an object of the present invention to provide improved control mechanisms for tilting the vanes, louvers or slats of a vertical blind and for opening and closing the blind.

It is another object of the present invention to provide an improved holder for suspending the vertical blind vanes or slats from carriers within the head of the vertical blind.

It is still another object of the present invention to provide a carrier for supporting a slat or vane holder in a vertical blind which is simplified and improved over such carriers in heretofore known vertical blinds.

A still further object of the present invention consists of providing improved means for connecting vertical blind head to a support, such as a ceiling.

A still further object of the present invention consists in providing a vertical blind slat or vane with improved means for facilitating closing of the blind.

Still another object of the present invention consists in providing a new and improved control carrier for tilting a wand-operated vertical blind.

A still further object consists in providing an improved weight for placing the traverse cords of a vertical blind under tension.

It is still another object to provide means for keeping the control cords of a vertical blind separated.

It is also an object of the present invention to provide new and improved means for spacing the blind carriers from each other.

BRIEF SUMMARY OF THE INVENTION

The above-mentioned objects have been realized in a vertical blind with a blind head, a number of carriers supported for reciprocating movement in the head and a number of holders respectively supported in the carriers for pivotal movement and adapted to support a number of vanes therefrom, by novel control means for controlling the reciprocating movement of the carriers and the pivotal movement of the holders, including first bevel gears respectively rotatably supported in the carriers and mounted for rotation with the tilt rod of the blind and second bevel gears respectively connected to the holders and mounted for meshing engagement with the first bevel gears. The carriers are interconnected by special spacer bands and have special openings for receiving the draw or traverse cord. Also, a novel intermediate support carrier is provided for supporting the draw or traverse cord in the middle area of the blind head, and a novel weight for taking up the slack of the traverse cord. Still further, the vertical blind according to this invention includes vanes provided with special slots for receiving a chain interconnecting the vanes, and also a cord separator for keeping separated the strands of the tilt cord and of the traverse cord, if they are both located on the same side of the blind head.

BRIEF DESCRIPTION OF PREFERRED EMBODIMENTS OF THE INVENTION

The invention is illustrated, by the way of example, in the accompanying drawings, in which:

FIG. 13 shows an enlarged view of a detail encircled in FIG. 1;

FIGS. 14 and 15 are partial elevational views respectively of the top and bottom part of a vane used in the vertical blind according to FIG. 1;

FIGS. 16 and 16A are top views of a vane showing other inventive features of applicant's vertical blind.

FIG. 17 illustrates a strip of material used for suspending a blind vane of soft material, such as cloth or fabric from the holder in the blind head;

FIG. 18 shows a vertical blind vane to be combined with the strip shown in FIG. 17;

FIG. 19 shows the strip and vane of FIGS. 17 and 18 combined and engaged by a holder;

FIG. 20 is an elevational view of a weight to be used at the bottom of the vane according to FIG. 18;

FIG. 21 is a side view of the weight shown in FIG. 20;

FIG. 22 is a side view of the combination of the weight according to FIG. 20 with the bottom of the vane according to FIG. 18;

FIG. 23 shows a weight for taking up the slack in a traverse cord of a vertical blind;

FIG. 24 is a longitudinal section through a blind head of a further embodiment of a vertical blind according to the present invention;

FIG. 25 is an end view of the tilting unit for the blind, as seen in the direction of line 25—25;

FIG. 26 is a top view as seen in the direction of line 26—26 in FIG. 25, with parts omitted for clarity;

FIG. 32 illustrates a modification of the tilter of FIGS. 7 to 9;

FIG. 42 is a side view of a vertical blind illustrating the problem of cord sagging in a blind without an intermediate support;

FIG. 43 shows a detail encircled in FIG. 42;

FIG. 44 is a side view of a vertical blind with a non-sagging draw cord;

FIG. 45 shows a detail encircled in FIG. 44;

FIG. 46 is a section taken along the line 46—46 through a station illustrated in FIG. 45;

FIG. 47 is a section taken along the line 47—47 of FIG. 46;

FIG. 48 is a side view, partly in section, of an alternative element used in the station illustrated in FIG. 46;

FIG. 49 is a view similar to that of FIG. 45 but illustrating alternative means for exerting drag on the draw cords of the vertical blind; and FIG. 50 is an end view of the embodiment shown in FIG. 49.

DETAILED DESCRIPTION OF PREFERRED EMBODIMENTS OF THE INVENTION

Figure 1:
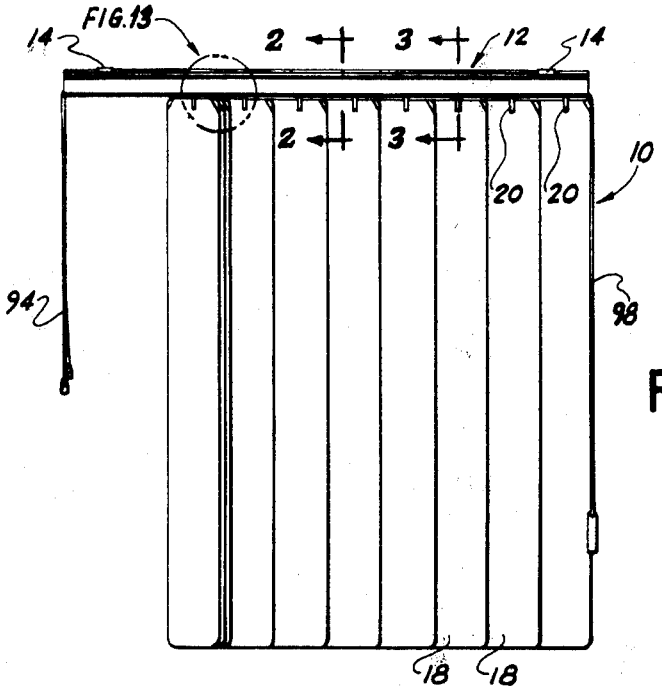
FIG. 1 is an elevational view of a vertical blind embodying the principles of the invention and showing the blind in partially traversed opened position.

Referring now to the drawings in detail, FIGS. 1 to 13 show one embodiment of a vertical blind in accordance with the present invention, generally designated with the reference numeral 10. The vertical blind comprises a head 12 to be suspended from a support, such as a bracket or support surface, for instance a ceiling, by brackets 14 (FIGS. 2 and 2A) by means of screws 16. The vertical blind further comprises a plurality of vanes or slats 18 which are suspended from holders 20 which in turn are supported in carriers 22 movable within blind head 12.

The vertical blind 10 also comprises means (to be described in detail further below) for tilting the vanes or slats 18 about substantially vertical axes from open to closed position and vice versa, through an infinite number of intermediate positions, and also means for traversing the carriers 22 including the holders 20 and vanes 18, within the length of the blind head, to the right or left, from one end to the other and vice versa through intermediate positions. These controls, for tilting and for traversing the blind are shown in FIGS. 2 through 12 for one embodiment of the invention and will be described in greater detail further below. While in the embodiment shown in FIG. 1 the blind opens from left to right, this is by way of example only. It is, of course, possible to design the blind so that its opens from the left, or from the center (bi-partite blind), for instance.

The blind head 12 is substantially of square across section and comprises a top wall 24, side walls 26 and 28 integral with the top wall, and a bottom wall 30. Each bracket 14 for connecting the head to a support, has an oblong hole 13 for the screw 16 and has a first curved end 15 engaging one edge 24*a* of the head and a second curved end 17 for engaging the opposite edge 24*b* of the head. End 17 is curved back to form a tab 19 to permit insertion of a screw driver between side wall 28 and tab 19 to detach the head from the support.

The blind head may be provided with means for attaching thereto decorative valances 32. In the case illustrated in FIG. 2, the valances 32 are received in grooves 34 formed by longitudinally extending upper and lower protrusions 36 in front and back of the head. Bottom wall 30 has a relatively wide slot 31 and provides a sliding surface or rail for the carriers 22.

Each carrier comprises end walls 38 and side walls 40 and is molded from a suitable plastic material. Carrier 22 is provided with grooves 42 which permit the carrier to be inserted in head 12 so that it may rest at 43 on the bottom wall 30 of the blind head 12. Carrier 22 is also provided with a substantially rectangular opening 44 through which the holder 20 can be inserted from the top, and a slot 46 for a purpose to be described further below. Carrier 22 provides a seat 48 and a circumferential support 50 for holder 20.

Figure 6:
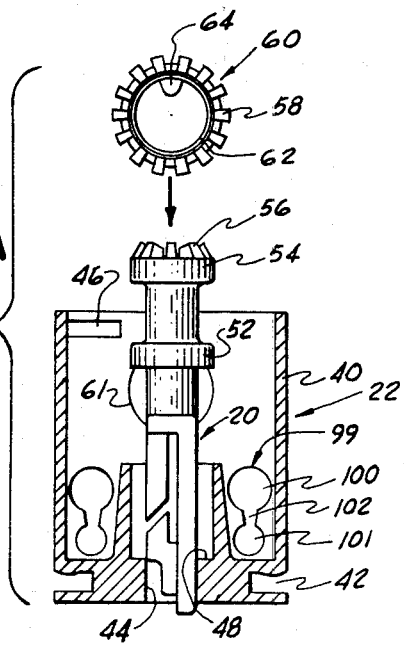
FIG. 6 is an exploded partial section of the carrier shown in FIG. 3.

As shown in FIG. 6, during assembly the holder 20 is introduced from the top until it rests with a seat 52 on seat 48 of carrier 22. Holder 20 also comprises a bevel gear 54 provided with teeth 56 which are adapted to mesh with teeth 58 of a bevel gear 60 which is likewise introduced into carrier 22 from the top, as shown in FIG. 6, until it snaps into two opposite circular openings 61 in carrier 22, with seats 62. Gear 60 is provided with a key 64 for a purpose to be described later.

Holder 20 is likewise made from a suitable plastic material. In addition to the gear 54 and seat 52, the holder comprises a first shank 66 which in its operative position extends substantially vertically, a second shank 68 extending substantially parallel to shank 66, and a hook-like portion 70 extending from shank 66. Shanks 66 and 68 form therebetween a slot 72. The holder is also provided with a slot 76 which extends at an acute angle, preferably of about 45°, with respect to slot 72.

Slot 72 receives the upper portion of a vane 18. More specifically, as shown in FIG. 14, the vane 18 is provided with an opening 74. During assembly a portion 78 between opening 74 and the top edge 75 of vane 18 is passed through slot 76 into slot 72 and comes to rest in the lower portion 73 of slot 72 on portion 70. The arrangement is such that vane 18 can easily be introduced through the inclined slot 76, but once it is received in the lower portion 73 of slot 72 it cannot be disloged easily from the slot. In this way, accidental or casual removal of the vane 18 from the holder 20 is prevented, while nevertheless the vane can be removed if this should be necessary for cleaning or replacement, by lifting the vane 18 until the lower edge of portion 78 passes beyond the upper edge 71 of portion 70.

Figure 3A:
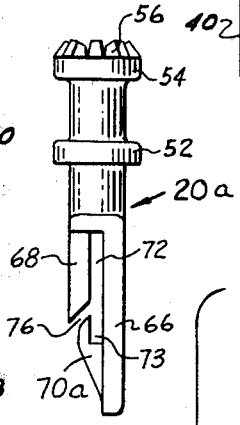
FIG. 3A shows an alternative form of a vane holder shown in FIG. 3.
Figure 3:
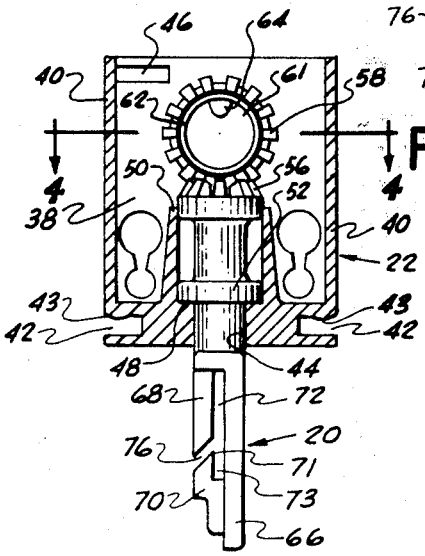
FIG. 3 is an enlarged cross-section taken along line 3—3 of FIG. 1, with the blind head and some components of the carrier omitted for clarity.

A slightly different embodiment of a holder is shown in FIG. 3A. Holder 20a has a hook-like portion 70a which has a substantially continuous outer surface. This permits the vane to slide right into place as it is being pushed up. When using this holder a slight change has also to be made in the opening 74 in vane 18. Opening 74a is rectangular instead of square as indicated in dot-dash lines in FIG. 14.

Figure 2:
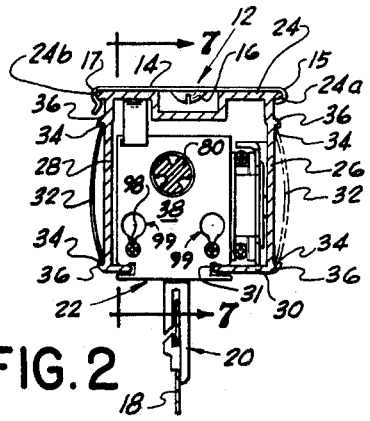
FIG. 2 is an enlarged section through the blind head taken along line 2—2 of FIG. 1 and showing a carrier supporting a vane in the head.
Figure 2A:
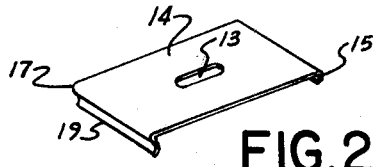
FIG. 2A is a perspective view of a plate for connecting the blind head to a support such as a bracket or overhead support surface or ceiling.
Figure 4:
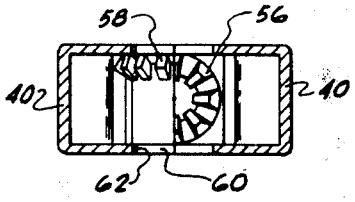
FIG. 4 is a section taken along the line 4—4 of FIG. 3.
Figure 5:
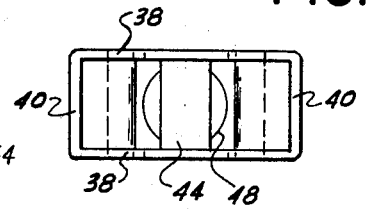
FIG. 5 is a top view of FIG. 3, with some components omitted.
Figures 7, 8A, 8B, 9, 10, 11, 12:
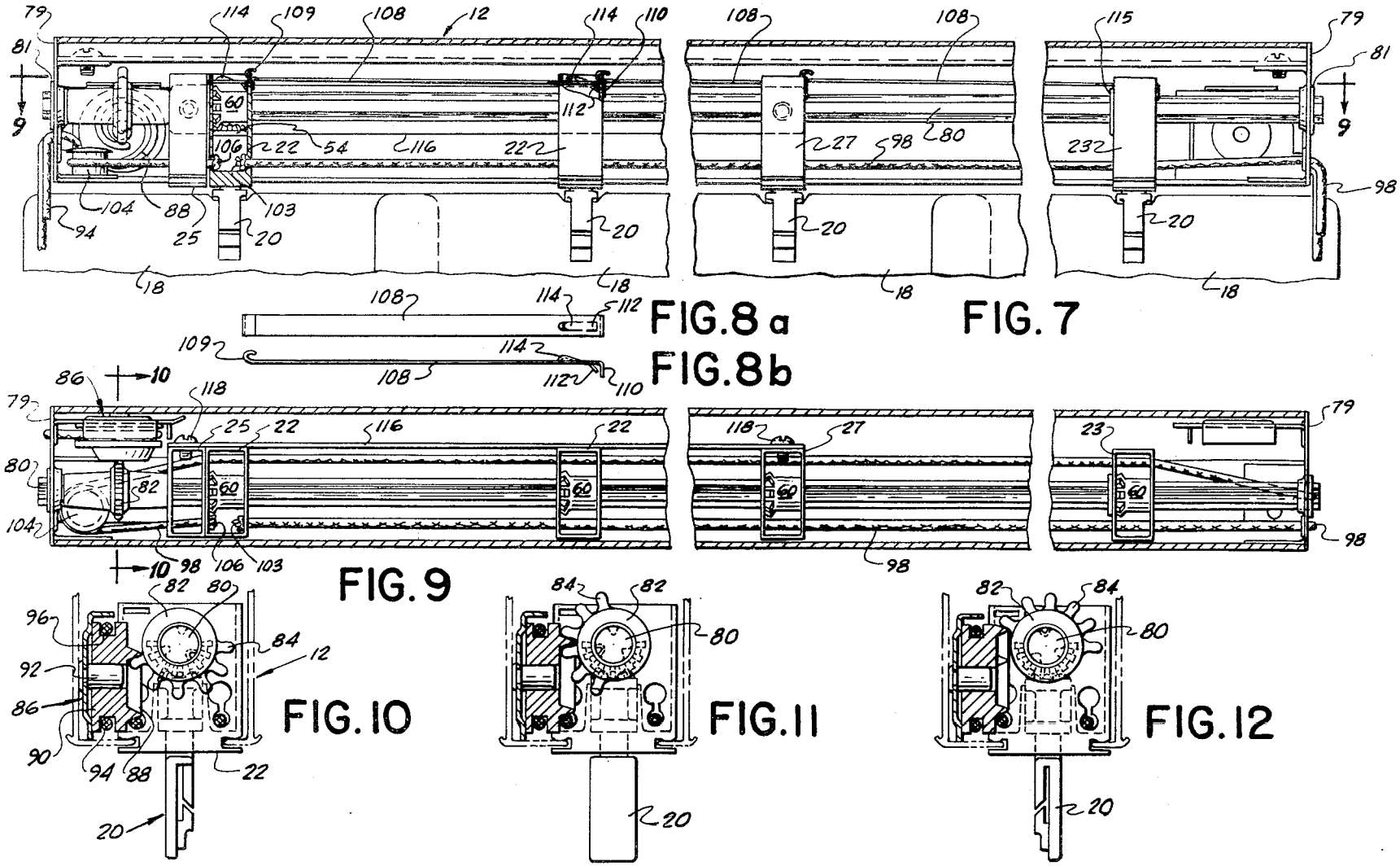
FIG. 7 is a longitudinal section through the blind head taken along the line 7—7 of FIG. 2.
FIG. 8A is a top view of a spacer strip for use between adjacent carriers.
FIG. 8B is a side view of the spacer strip of FIG. 8A.
FIG. 9 is a longitudinal section through the blind head; taken along the line 9—9 of FIG. 7.
FIG. 10 is a section taken along the line 10—10 of FIG. 9 showing the blind tilter when the vanes of the blind are tilted to closed position.
FIG. 11 is a section similar to that of FIG. 10, but showing the tilter when the vanes of the vertical blind are tilted to open position.
FIG. 12 is a cross-section similar to that of FIG. 10, but showing the tilter when the vanes of the blind are tilted closed in a position approximately 180° turned from that of FIG. 10.
Figure 27:
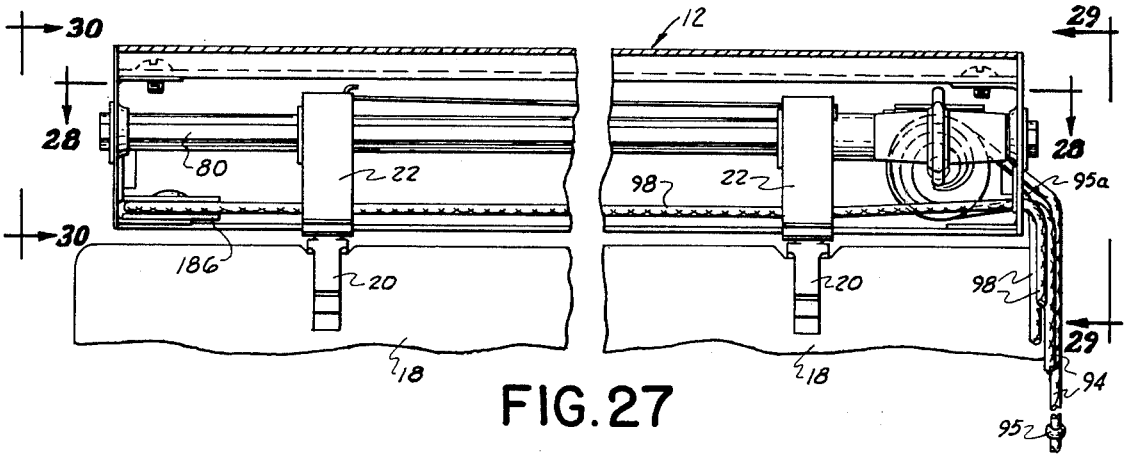
FIG. 27 is a longitudinal section through a vertical blind head showing a further embodiment of the invention.
Figure 28:
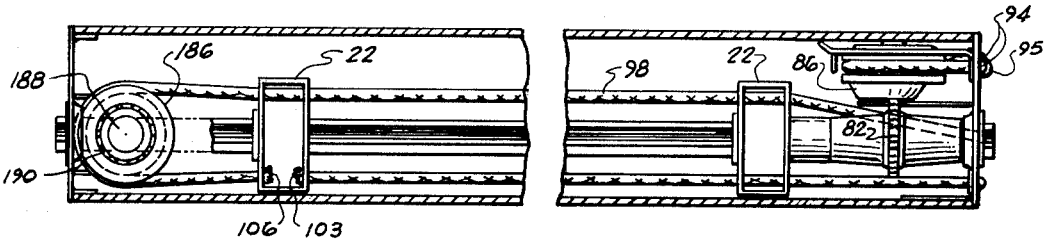
FIG. 28 is a longitudinal sectional view taken along line 28—28 of FIG. 27.
Figure 29:
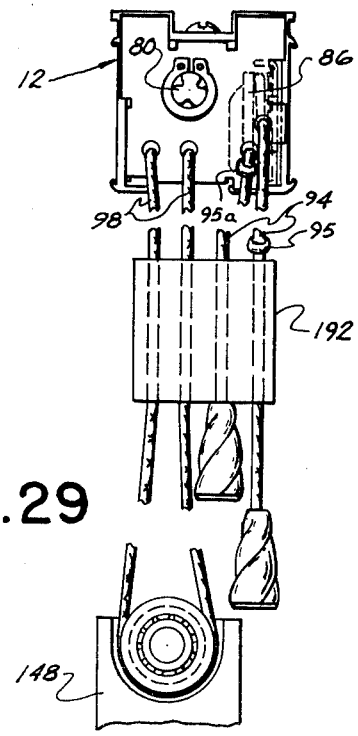
FIG. 29 is a right end view of the head of FIG. 27 as seen in the direction 29—29 of FIG. 27.
Figure 30:
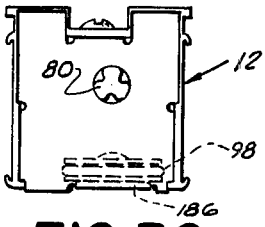
FIG. 30 is a left end view of the blind head according to FIG. 27, as seen in the direction 30—30 of FIG. 27.
Figure 31:
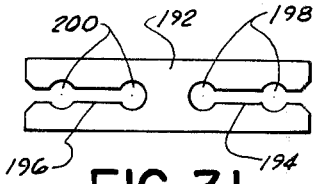
FIG. 31 is a top view of a cord separator.
Figure 33:
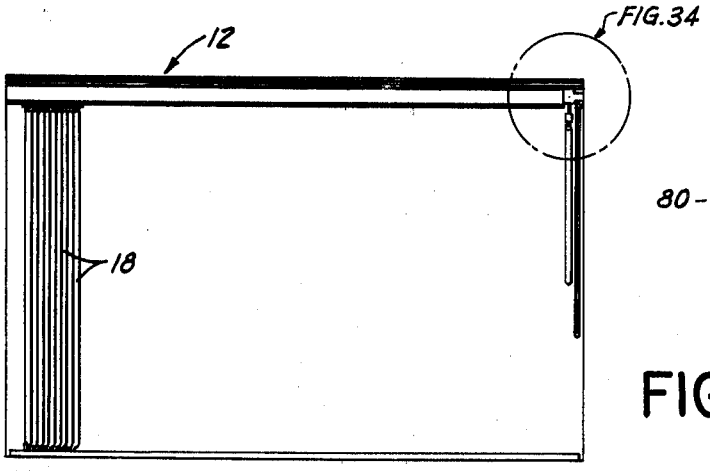
FIG. 33 is an elevational view of a further embodiment of a vertical blind according to the present invention, this blind being wand-operated.

FIGS. 7 and 9 represent longitudinal sections through the vertical blind head 12. A number of carriers arranged within head 12—number of course depends on the width of the blind—for supporting an equal number of vertically extending vanes 18, as shown in FIG. 1. Only four such carriers are shown in FIGS. 7 and 9. Almost all of the carriers have the form of the carriers designated with reference numeral 22, but there are three special carriers 23, 25 and 27, the purpose of which will be explained further below.

A tilt rod 80 is rotatably supported at 81 in end brackets 79 of head 12 and extends through each gear 60 in each carrier. Rotation of tilt rod 80, by means to be described later, causes rotation of gear 60 in view of key 64 and thereby of gear 54 which in turn rotates the holder 20 and respective vane 18.

Adjacent one end of the vertical blind head 12 the tilt rod 80 is provided with a gear 82 with teeth 84 (FIGS. 9 to 12). The means for oscillating the tilt rod 80 is generally designated with 86 and comprises a disc 90 with a spiral thread 88 on the face of disc 90, forming a worm. Disc 90 is rotatable about a pin 92 by means of a tilt cord 94 passed around a groove 96 in disc 90. As clearly shown in FIGS. 10 to 12, rotation of disc 90 by the tilt cord 94 will cause the worm 88 to rotate gear 82. Teeth 84 do extend over a limited portion of the circumference of gear 82 only so as to prevent damage to gear 82 if a person operating cord 94 continues to pull at the cord after the vanes 18 have reached their fully closed positions. The selection of the number of teeth is such that once the vanes have reached either end position, gear 82 runs out of mesh with worm 88 (see FIGS. 10 and 12). To prevent the opposite ends of the cord from being pulled up out of reach beads 95, 95a are attached to the branches of the cord, which beads also serve for keeping the branches synchronized with the vanes. In connection with horizontal venetian blinds this is described in U.S. Pat. No. 2,174,994 where the problems involved are similar.

Traverse of the vertical blind to fully open or fully closed position, i.e. movement of the vanes 18 to the right or left in FIG. 1, is effected by means of a cord 98 (see FIGS. 1, 7 and 9) which passes through all carriers 22, 23, 25 and 27, and more specifically through openings 99 therein. Openings 99 (FIG. 6) are of a special design. They comprise an upper circular portion 100, a lower circular portion 101 of smaller diameter than portion 100, and a portion 102 interconnecting portions 100 and 101 and tapering downwardly. Thus, the openings form a keyway for cord 98. One end 103 of cord 98 is affixed to the next to the last carrier on the left, that is in case the blind opens to the right. The cord passes on one side of each carrier outwardly to the right and returns through the other side of all carriers and around a pin 104 and is finally affixed at its other end 106 to the opposite side of the next to the last carrier on the left-hand side. The reverse applies if the blind opens to the left, i.e. the ends 103 and 106 would be affixed to the next to the last carrier on the right. This carrier could also be one of two center carriers in a bi-partite vertical blind where the vanes are traversed open and closed from the center.

The cord 98 has a core made of a material which does not stretch to an appreciable degree and does not melt, such as rayon, and also has a braided or woven cover of an abrasion resistant material, such as polyester or nylon, but which melts, when sufficient heat is applied.

During assembly of the blind, the ends of cord 98 are subjected to heat so that the cover melts into the core and locks the same to the core. This also will result in an enlarged end or "glob" of a diameter larger than opening portion 101 but smaller than portion 100. Thus, the ends 103 and 106 can be introduced through openings 100 into the carrier in question, such as the next to last carrier on the left in FIGS. 7 and 9. The cord is then forced downwardly through portion 102 into opening portion 101 and the ends 103 and 106 respectively come to rest against opposite walls 38 of the carrier. Even a large force exerted on the cord will not tear the end "globs" off and will not be able to move the cord from opening portion 101 into portion 100. The cord can be removed, however, by cutting ends 103 and/or 106 off. Due to these features of the carrier and cord arrangement according to the present invention, all carriers can directly abut each other with their end walls and will have equal spacing, since no cord ends protrude from the cord connecting carrier.

Spacer bands 108 extend between adjacent carriers, as clearly shown in FIG. 7. Each spacer band 108 has a curved end portion 109 which passes through slot 46 in one end wall of one carrier. Each spacer band has also an end portion 110 which is bent substantially at right angles to the major extension of spacer band 108 and which passes through both slots 46 in the end walls of the adjacent carrier. In order to hold the spacer band to the respective carrier, a portion 112 has been partially punched out of the main body of the spacer band 108 and bent downwardly so that the one end wall 38 of the respective carrier extends between portions 110 and 112 of spacer band 108. The spacer band is also provided with a portion 114 bent out of the plane of the spacer band, for instance by deep drawing or the like. In this way a smooth "hill" is formed.

As mentioned above, in addition to the carriers 22, the vertical blind 10 comprises special carriers 23, 25 and 27. The carrier 23 at the extreme right (when the blind is operated from the right) is held stationary by a retainer ring 115, but in all other respects it conforms to carriers 22, i.e. it is provided with a gear 60 for rotating the holder 20 suspended therefrom. Carrier 25 at the extreme left is movable along bottom wall 30 of head 12, but it has no gear, no holder and no vane attached thereto.

When opening the vertical blind from its closed position, shown in FIG. 7, pulling at cord 98 will cause the last carrier 22 on the left, i.e. the carrier 22 next to carrier 25—since it is the one engaged by end 103 of the cord—to move along head 12 to the right until it abuts the next carrier 22. During this movement spacer 108 will pass through the opening 46 in the last carrier 22 on the left, being pushed upwardly by bent, smooth portion 114 out of the way of the opposite wall 38. Upon further pulling at cord 98 the two left-hand carriers 22 will engage the third and will cause the same to move to the right. This movement may continue until the rightward moving carriers 22 reach the special carrier 27 which is connected to carrier 25 via a link 116 screwed respectively to carriers 27 and 25 by means of screws 118. This will cause carrier 25 to move to the right and provide an intermediate support for the horizontal run of both branches of cord 98. Such intermediate support is optional for smaller blinds, but becomes increasingly important in wider blinds, i.e. blinds wider than about 48 inches. The blind is open completely when all carriers 22 (and carrier 27) have moved to the extreme right and reach carrier 23.

When drawing the vertical blind closed, the extreme left carrier 22 will start moving to the left—since it is engaged by end 106 of the cord—and upon reaching a certain distance will pull the next carrier 22 to the right thereof once the hook portion 109 returns to the end wall 38 adjacent slot 46. The other carriers will be moved to the left one by one upon respective engagement by the hook portion 109. When carrier 27 is being pulled to the left it pushes ahead of itself the intermediate support carrier 25 until the same reaches its end position.

As shown in the left-hand portion of FIG. 1 and in FIGS. 13 and 14, the vanes 18 may be provided with bent upper corners 18*a*, on either one side or both, to facilitate drawing the blind open with the vanes 18 closed. In this way the corners of the vanes do not become caught under holder 20 of the next vane.

FIG. 15 illustrates the bottom portion of a vane 18, the upper end of which is shown in FIG. 14 and has been described previously. The lower end of vane 18 is provided with a slot 120 having a narrow portion 122, a widened upper portion 123, preferably circular, and a widended lower portion 126 which is preferably rectangular, with the major extension in horizontal direction. A chain 121 (see FIG. 16) is passed through the slots 120 in order to keep the vanes 18 from moving too far away from each other while at the same time giving the vanes sufficient freedom to move within a normal range. When assembling the blind the chain is passed through the holes 124, and when appropriately spaced the string or wire between adjacent beads 123, 125 is forced through portion 122 into portion 126. The purpose of widening portion 126 is to enable the chain 121 to pass as closely as possible to vane 18 and not along a wide arc which would be the case if portion 126 were circular and of smaller diameter than portion 124.

In accordance with another development illustrated in FIG. 16A, adjacent vanes 18 may be interconnected by separate short chains 121*a*, 121*b* instead of one long chain 121. Chain 121*a* extends from portion 126 of vane 18 to portion 126 of an adjacent vane on one side, while chain 121*b* extends from portion 126 of vane 18 to portion 126 of an adjacent vane on the other side of vane 18. Chain 121*a* is inserted in slot 124 between two beads 125*a* and 125*b*, pushed through portion 122 and into portion 126 of slot 120 in vane 18. Similarly, chain 121*b* is received in slot 124 between two beads 123*a* and 123*b*, pushed through portion 122 and into portion 126 of slot 120. Assembly of a vertical blind is greatly facilitated since only short lengths of chain with a small, equal member of beads depending on the width of the vane, are used. A vane can easily be removed without the chain having to be cut.

A modified vane is shown in FIGS. 17 through 22. This vane 128 is made of a flexible material, such as, for instance, fabric or cloth. It is over-lapped at the upper end as shown at 130 and is provided with a cut-out 132. A strip 134, for instance of aluminum, with a hole 136, similar to hole 74 shown in connection with vane 18, may be passed through opening 138 at either end of the folded section 130. This enables a holder 20 as described previously to engage the strip 134 at the opening 132 to connect the vane to the respective carrier 22, 25 or 27, as previously described. Strip 134 may be provided with bent edges 135, although in most applications this may not be necessary.

FIG. 20 shows a weight 140 which is inserted in a lower folded portion 142 of vane 128. Weight 140 is provided with ears 144 having slots 146 similar to slots 120 in the vanes 18 and for the same purpose, namely, for receiving a chain similar to chain 121 shown in FIG. 16. The ears 144 may be bent as shown in FIG. 22 to prevent the weight 140 from being accidentally removed from vane 128.

FIG. 23 shows a weight 148 to be attached to cord 98 in order to take up any slack over the length of the blind head. Cord 98 might otherwise interfere with the proper operation of the blind. Weight 148 comprises a wheel 150 which is rotatably supported on a pin 152 by means of a ball bearing indicated at 154. A small gap 156 is left between the actual body of weight 148 and the wheel 150 to be able to insert the cord 98 easily around wheel 150, as shown at 158. Weight 148 may be made from a clear or opaque plastic material and provided with a number of small circular indentations 149. At these places bores may be drilled and slugs 151 inserted, if additional weight is required, for instance in the case of very wide blinds.

FIG. 24 shows an alternate control for tilting and for traversing the vanes, which differs from that shown in FIGS. 1 to 12 in that the control is effected by a wand 160, rather than by two separate cords 94 and 98 as shown in FIG. 1 and described in the first embodiment of the invention. Wand 160 is connected to a control station 162 via a universal joint 164 which has a first part 166 connected to the wand 160 by means of a screw 168 and a second part 170 connected to a shaft 172 via a screw 174. Shaft 172 is provided with a pinion 176 of a special design shown in FIG. 26. Pinion 176 meshes with a gear 178 which is mounted on or integral with a sleeve 180, which in turn is mounted on a tilt rod 182. Relative rotation of sleeve 180 with respect to tilt rod 182 is prevented by a key 184. In a manner similar to hat described in connection with the embodiment of FIGS. 1 to 12, the vertical blind of FIG. 24 comprises carriers 22 which in all essential parts correspond to the carriers 22 described in connection with FIGS. 1 to 12. Thus, rotation of tilt rod 182 results in a tilting of holders 20. The carriers 22 of FIG. 24 do, of course, not require openings for a traverse cord.

A number of "dummy" carriers 29 are interposed between the extreme left carrier 22 and control station 162 to provide sufficient space for proper operation of the blind, i.e. in order to enable the first vane to clear the wand. Fasteners, such as two nails 171, may be passed through holes 173 to connect the last carrier 22 on the left and the dummy carriers 29, to the control unit 162.

Movement of part 170 in the direction of the arrow 184 will result in traversing the vanes of the open blind, and movement in the direction opposite to that of arrow 184 will result in traversing the vanes of the blind closed. Again, the individual carriers 22 are interconnected by spacers 108 described in detail in connection with FIGS. 7 through 9.

A further embodiment of the vertical blind according to this invention is illustrated in FIGS. 27 through 31, which is generally similar to that of FIGS. 1 through 12, except that the control for tilting and for traversing the vanes 18 is arranged on one and the same side of the blind, i.e. the right side in the embodiment illustrated in FIGS. 27 through 31, although of course this arrangement could be reversed and the controls be located on the left side.

Cord 98 for traversing the vertical blind is connected to the extreme left end carrier 22 at 103 and 106 respectively and is passed around a wheel 186 which for ease of rotation is mounted on a pin 188 through the intervention of a ball bearing 190.

The individual strands of cords 94 and 98 are kept properly separated by a cord separator 192 provided with slots 194 and 196 and individual grooves 198 and 200 for respectively receiving the cords 94 and 98.

In the case of a very wide vertical blind it may be advantageous to use two drive units 86, instead of one, for tilting the vanes or slats 18. Such an arrangement is shown in FIG. 32 in which the drive unit 86 shown on the left in FIGS. 7 and 9 is repeated on the right side of the blind. Therefore, there exists a common tilt rod 80 with two gears 82, one at each end, and two worms 88. The tilt cord 94 runs from one end of the blind head, over the disc 90 of the first unit 86, to the disc 90 of the other unit 86 and returns to the first unit.

A further embodiment of the vertical blind according to the present invention is illustrated in FIGS. 33 to 39. It differs from the embodiments of FIGS. 1 and 24 in that it is wand-operated. However, many parts of the embodiment of FIGS. 33 to 39 are identical to those in FIGS. 1 and 24 and such parts have been identified with the same numerals. The blind head 12 is provided with an end bracket 202 supporting a tilt rod 80. Bracket 202 also supports on flanges 204 and 206, a worm 208 having a shaft 210 which is connected to a wand 212 by connecting means generally designated with the reference numeral 214. Worm 208 meshes with a gear 216 (see FIG. 35) which, in contrast to the gears shown in FIGS. 7 to 12 and 24 to 26, is provided with a full compliment of teeth over its entire circumference. It is made of a suitable plastic material and pressfit onto the metal tilt rod 80 so that if a person operating the wand 212 should continue to rotate gear 210 even after the blind is completely closed in one direction or the other, gear 216 wll merely slip on tilt rod 80 without causing any damage to the teeth of either gear 216 or worm 208.

Figure 36:
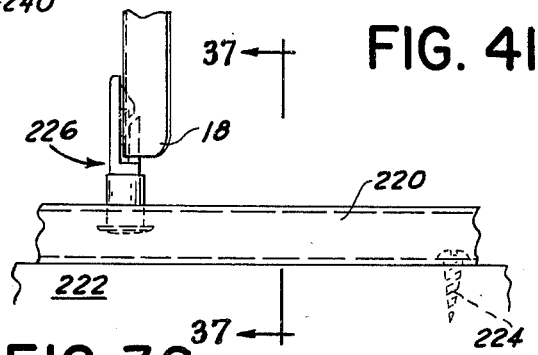
FIG. 36 is a detailed view of the lower portion of FIG. 33, showing a bottom rail for the vertical blind.
Figure 37:
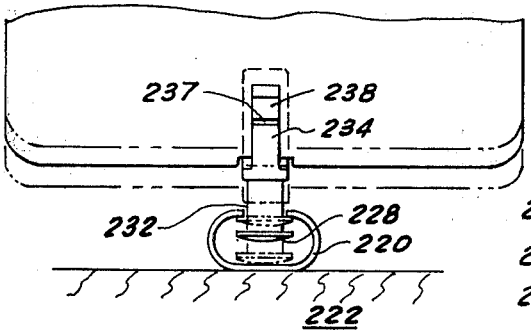
FIG. 37 is a section taken along the line 37—37 of FIG. 36.
Figure 38:
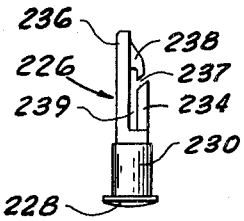
FIG. 38 shows a holder for holding a vane to the bottom rail.

It has been found advantageous in some applications, especially for vertical blinds close to doors that are opened or closed frequently, to prevent the lower ends of the vanes 18 from swinging back and forth from their rest positions. This is accomplished as shown in FIGS. 36 to 38, by a bottom rail 220 which may be mounted to a floor 222 or other suitable support surface, such as a windowsill, by various means, for instance by screws 224. Rail 220 shown in FIG. 37 is substantially oval. However, the specific shape is immaterial to its function. Each vane 18 is provided with a holder 226 having a head 22 received in rail 220, and a main body 230 protruding through an opening 232 in rail 220. Holder 226 also comprises two shanks 234, 236 and a hook-like projection 238. Holder 226 is very similar to holder 20 connecting the vanes 18 to carriers 22. A slot 237 remains between 234 and 238 to permit passage therethrough of the bottom end of a vane 18 to be received in a slot 239.

FIG. 37 shows in dot and dash lines the possible upper and lower most positions of the vane 18 and head 228 to compensate, for instance, for any irregularities in the floor 222 or the ceiling to which the head 12 is attached.

Figure 35:
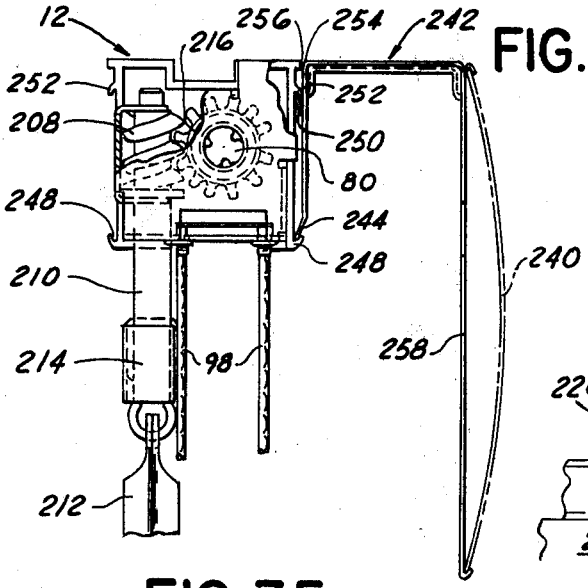
FIG. 35 is an end view of FIG. 34, also showing a valance and a holder for the valance.
Figure 39:
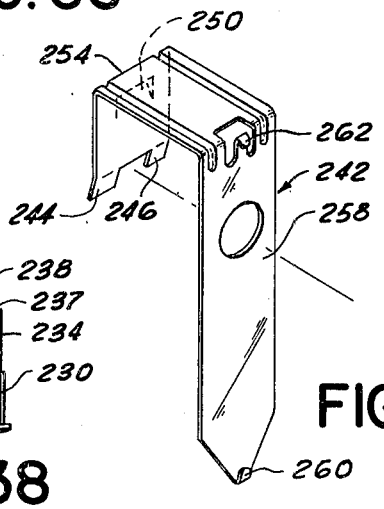
FIG. 39 is a perspective view of the valance holder shown in FIG. 35.

As shown in FIGS. 35 and 39, the vertical blind head 12 may be provided with a valance 240 which is supported at head 12 by means of a bracket 242. This bracket is provided with projections 244 and 246 received in a channel 248 of blind head 12 and is also provided with a projection 250 received in a channel 252 in blind head 12. Bracket 242 rests with an edge 254 against an edge 256 of blind head 12. The main body 258 of bracket 242 is provided with prongs 260 and 262 between which the valance 240 is received, as clearly shown in FIG. 35. It is to be understood that valance holder 242 may be attached on either side of head 12.

The embodiments of FIGS. 7 and 9 are provided with an intermediate support, such as a carrier 27. Without such an intermediate support cord 98 would sag when the blind is open, as illustrated in exaggerated form in FIGS. 42 and 43. This problem has been eliminated in accordance with a further development of the present invention, without having to use an intermediate support. Several forms are illustrated in FIGS. 44 to 50, and also in FIGS. 34, 40 and 41.

The vertical blind is equipped again with a vertical blind head 12 carrying a number of vanes 18 controlled by a wand 212 and a cord 98. Vanes 18 are suspended from carrier stations 22. In the embodiment of FIGS. 44 to 47, there is provided a station 270 which differs from the carriers 22 by means for exerting a drag on cord 98. The housing of station 270 is similar in most respects to carriers 22 previously described. However, it does not have a holder 20 suspended therefrom, and instead is provided with a clamp 272 and a screw 274 passing through the hole 44 in station 270. Screw 274 is threadedly received in clamp 272 and exerts pressure on cord 98 via intermediate members 276. As a result, when a person pulls at cord 98 to open the vertical blind, a drag is exerted on the part of the cord not supported by any carrier within the vertical blind head 12 and thus keeps this part of the cord 98 uner tension so that it does not sag as would otherwise be the case, as clearly illustrated in FIGS. 42 and 43.

The arrangement shown in FIGS. 46 and 47 may be simplified by combining clamp 272 and members 276 in one unitary structure, as illustrated in FIG. 48, showing a clamp 278 with a threaded bore 280 for receiving the screw 274. When assembled in station 270, the surfaces 281 will come to rest and exert pressure of a drag on draw cord 98.

Still another form of the means for exerting a drag on the draw cords 98 is illustrated in FIGS. 49 and 50. It comprises a drag plate 282 which is clamped onto the end of tilt rod 80 by means of a resilient ring 284. Plate 282 exerts pressure on cords 98 at a location slightly below the right angle turn of cords 98 after they have passed through holes 286 in end bracket 288 of the blind head 12.

Figure 34:
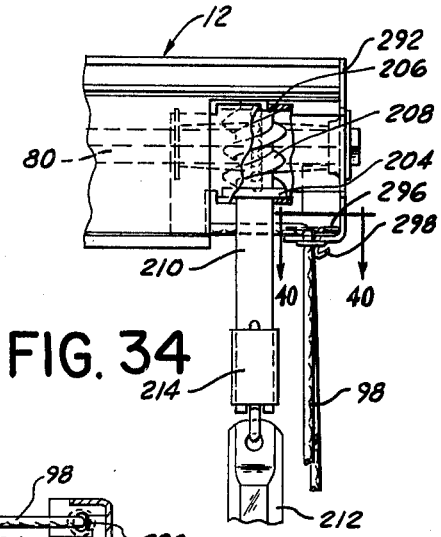
FIG. 34 is an enlarged view of a detail encircled in FIG. 33, including means for exerting a drag on the draw cords.
Figure 40:
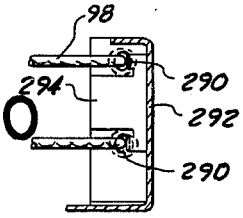
FIG. 40 is a section taken along the line 40—40 of FIG. 34.
Figure 41:
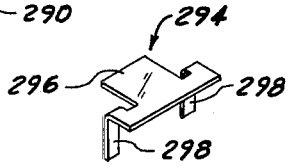
FIG. 41 is a perspective view of a drag-plate for use in the vertical venetian blind head shown in FIG. 34.

Still another embodiment is illustrated in FIGS. 34, 40 and 41. In this instance, the draw cords 98 are passed through holes 290 in the bottom portion of an end bracket 292. Pressure is exerted onto draw cords 98 by a drag plate 294 which prior to assembly, has the shape illustrated in FIG. 41, including a relatively wide portion 296, and two narrow portions 298 substantially at right angles with respect to portion 296. Upon insertion of portions 298 into holes 290, portions 298 are bent backwardly and upwardly, as shown in FIG. 34, and exert a drag on portions of cords 98 just below their right angle turn.

The means for exerting drag on the draw cord shown in FIGS. 34, 40 and 41 and in FIGS. 49 and 50 are advantageous when compared with those of FIGS. 45 to 48. A much, much smaller pressure, on the draw cord is sufficient to prevent the same from sagging, because production of the drag force is aided by the right angle turn in the cord.

It is, of course, understood that the invention is not limited to the embodiments shown and/or described in the above specification, but by the scope of the appended claims.

I claim:

1. A vertical blind, comprising: a blind head, a plurality of carriers supported for reciprocating movement in said head, a plurality of holder means respectively supported in said carriers for pivotal movement and respectively adapted to support a plurality of vanes therefrom, and control means for controlling said reciprocating movement of said carriers and for controlling said pivotal movement of said holder means, said control means including rod means rotatably supported in said head, means for rotating said rod means comprising a first gear, means for connecting said first gear to said rod means, worm gear means rotatably supported in said blind head about an axis extending in a plane parallel to the plane passing through the axis of rotation of said rod means and perpendicular to said axis of rotation, said worm gearm means comprising a worm for meshing engagement with said first gear, and means for rotating said worm gear means about its axis, whereby rotation of said rod means by said rotating means will rotate said holder means.

2. A vertical blind according to claim 1, wherein said first gear is pressfit on said rod means, whereby said first gear will rotate said rod means upon rotation of said worm gear means under normal operating conditions, but will slip on said rod means upon being subjected to excessive force.

3. A vertical blind according to claim 1, wherein said means for rotating said worm gear means comprises a wand, means connected to said worm gear means for rotation therewith, and a universal joint interposed between said last-mentioned means and said wand, whereby rotation of said wand will rotate said worm gear means and thereby said plurality of holder means via said first gear.

4. A vertical blind according to any one of claims 1 to 3, wherein said control means for controlling said reciprocating movement of said carriers comprises a cord extending through said carriers and substantially over the length of said blind head, and means associated with said cord for exerting a drag on said cord to keep said cord taut.

5. A vertical blind according to claim 4, wherein said cord has two substantially parallel strands and wherein said means for exerting a drag on said cord comprising a carrier station through which said strands pass, means in said carrier station for engaging said strands, and clamping means for exerting adjustable pressure on said engaging means and thereby on said strands.

6. A vertical blind according to claim 5, wherein said clamping means includes a screw threadedly engaging said engaging means.

7. A vertical blind according to claim 4, wherein said blind head comprises passage means for said cord, and wherein said means for exerting a drag on said cord comprises a plate arranged to engage said cord adjacent said passage means, and means for exerting pressure on said plate and thereby on said cord.

8. A vertical blind according to claim 7, wherein said passage means extend through said blind head in a direction substantially parallel to said rod means, and said cord after passing through said passage means extends over a portion substantially at right angles thereto, and wherein said plate engages said cord at said portion.

9. A vertical blind according to claim 7, wherein said passage means extend through said blind head in a direction substantially perpendicular to said rod means, and wherein said plate comprises means extending through said passage means, and means exerting pressure on said cord below said passage means.

10. A vertical blind according to claim 1, comprising a plurality of vanes respectively suspended from said holder means, each of said vanes having a first end portion for connection to the respective holder means, and a second end portion remote from said first end portion, and means connected to said second end portion for confining movement of the same to a predetermined range.

11. A vertical blind according to claim 10, wherein said last means includes rail means adapted to be connected to a surface below said blind head, and a plurality of holders for respectively slidably connecting said second end portions of said vanes to said rail means.

12. A vertical blind according to claim 11, wherein each holder comprises a first shank, a second shank substantially parallel to said first shank and spaced therefrom sufficiently to form a first slot therebetween for receiving said second end portion of said vane, and a hook portion connected to one of said shanks, said hook portion and said other shank forming a second slot therebetween which extends at an angle with respect to said one shank and which communicates with said first slot, whereby said second end portion of the respective vane is received through said second slot in said first slot and thereby connected to said respective holder.

13. A vertical blind according to claim 12, wherein each holder has a body connecting said two shanks, and a head larger in size than said body, and wherein said rail means defines the longitudinal passage for receiving the heads of said holders, and a longitudinal slot communicating with said longitudinal passage for receiving said bodies of said holders.

14. A vertical blind according to claim 1, comprising a plurality of brackets with means for engaging said blind head and with means for supporting a valance.

15. A vertical blind according to claim 14, wherein said means for connecting said brackets to said blind head include channel means at said blind head and tab means at said brackets for connection to said channel means.

16. A vertical blind according to claim 14, wherein said means for connecting a valance to said brackets comprises a plurality of vertically spaced tabs respectively connected to said brackets.

17. A vertical blind, comprising: a blind head, a plurality of carriers supported for reciprocating movement in said head, a plurality of holder means respectively supported in said carriers for pivotal movement and respectively adapted to support a plurality of vanes therefrom, and control means for controlling said reciprocating movement of said carriers and for controlling said pivotal movement of said holder means, said control means for controlling said reciprocating movement of said carriers comprising a cord having two substantially parallel strands extending through said carriers and substantially over the length of said blind head, and means associated with said cord for exerting a drag on said cord to keep said cord taut, said last-mentioned means comprising a carrier station through which said strands pass, means in said carrier station for engaging said strands, and clamping means for exerting adjustable pressure on said engaging means and thereby on said strands.

18. A vertical blind according to claim 17, wherein said clamping means includes a screw threadedly engaging said engaging means.

19. A vertical blind comprising: a blind head, a plurality of carriers supported for reciprocating movement in said head, a plurality of holder means respectively supported in said carriers for pivotal movement and respectively adapted to support a plurality of vanes therefrom, and control means for controlling said reciprocating movement of said carriers and for controlling said pivotal movement of said holder means, said control means for controlling said reciprocating movement of said carriers comprising a cord extending through said carriers, substantially over the length of said blind head, and through passage means in said blind head, and means associated with said cord for exerting a drag on said cord to keep said cord taut, including a plate arranged to engage said cord adjacent said passage means, and means for exerting pressure on said plate and thereby on said cord.

20. A vertical blind according to claim 19, wherein said passage means extend through said blind head in a direction substantially parallel to said rod means, and said cord after passing through said passage means extends over a portion substantially at right angles thereto, and wherein said plate engages said cord at said portion.

21. A vertical blind according to claim 19, wherein said passage means extend through said blind head in a direction substantially perpendicular to said rod means, and wherein said plate comprises means extending through said passage means, and means exerting pressure on said cord below said passage means.

22. A vertical blind according to claim 1, comprising a plurality of vanes respectively suspended from said holder means, each of said vanes having a first end portion for connection to the respective holder means, and a second end portion remote from said first end portion and provided with opening means, said opening means comprising a first portion of substantially circular cross section, a second portion spaced from said first portion in the direction away from said first end portion, and a third opening portion interconnecting said first and second opening portions, said second opening portion being non-circular with a first dimension in a substantially vertical direction and a second dimension in a substantially horizontal direction which is greater than said first dimension, the width of said third portion interconnecting said first and second portions being narrower than the diameter of said first portion, and chain means interconnecting said plurality of vanes and extending through said second opening means.

23. A vertical blind according to claim 22, wherein said chain means comprises a plurality of chains respectively connecting two adjacent vanes.

24. A vertical blind according to claim 23, wherein each chain comprises a plurality of spaced beads, including two spaced beads at each end of said each chain, and means interconnecting each two spaced beads, one of said interconnecting means being received in said second opening means of one of said vanes, the other interconnecting means being received in said second opening means of an adjacent vane, to thereby interconnect said one vane to said adjacent vane.

25. A vertical blind according to claim 1, wherein each of said holder means comprises a first shank, a second shank substantially parallel to said first shank and spaced therefrom sufficiently to form a first slot therebetween for receiving a vane to be supported from said holder means, and hook means connected to one of said shanks and adapted to support said vane.

26. A vertical blind according to claim 25, wherein said hook means and said other shank form a second slot therebetween which extends at an acute angle with respect to said one shank and which communicates with said first slot, whereby a vane to be suspended from said hook means is adapted to be introduced through said second slot into said first slot.

27. A vertical blind according to claim 26, wherein said hook means has an inclined outer face below said second slot, and wherein the width of said hook means at said second slot is smaller than the width of said other shank at said second slot so that a vane when pushed from below will be guided along said inclined outer face and said hook means adjacent said second slot until it is caught in said second slot.

28. A vertical blind according to claim 1, wherein said blind head has a front wall and a rear wall, and wherein at least one of said walls is provided with means for holding a valance thereto.

29. a vertical blind according to claim 1, comprising a plurality of brackets with means for engaging said blind head and with means for supporting a valance.

30. A vertical blind according to claim 29, wherein said means for connecting said brackets to said blind head include channel means at said blind head and tab means at said brackets for connection to said channel means.

31. A vertical blind according to claim 29, wherein said means for connecting a valance to said brackets comprises a plurality of vertically spaced tabs respectively connected to said brackets.

32. In a vertical blind having a blind head with a plurality of carriers supported for reciprocating movement in said head: a plurality of holder means respectively supported in said carriers for pivotal movement and respectively adapted to support a plurality of vanes therefrom, each of said holder means comprising a first shank, a second shank substantially parallel to but considerably shorter than said first shank and spaced therefrom sufficiently to form a first slot therebetween for receiving a vane to be supported from said holder means, and hook means connected to said first shank and adpated to support said vane in said first slot, said hook means and said second shank forming a second slot therebetween below said second shank, which second slot extends at an acute angle with respect to said first shank and which communicates with said first slot, whereby a vane to be suspended from said hook means is adapted to be introduced through said second slot into said first slot, said hook means having an inclined outer face below said second slot, the width of said hook means at said second slot being smaller than the width of said second shank at said second slot so that a vane when pushed from below will be guided along said inclined outer face and said hook means adjacent said second slot until it is caught in said second slot.

* * * * *